US011370001B2

(12) United States Patent
Seippel

(10) Patent No.: US 11,370,001 B2
(45) Date of Patent: Jun. 28, 2022

(54) METHOD AND APPARATUS FOR CLEANING A HEAT EXCHANGER OR WATER SYSTEM

(71) Applicant: Jeffrey J. Seippel, Novi, MI (US)

(72) Inventor: Jeffrey J. Seippel, Novi, MI (US)

( * ) Notice: Subject to any disclaimer, the term of this patent is extended or adjusted under 35 U.S.C. 154(b) by 0 days.

(21) Appl. No.: 16/995,156

(22) Filed: Aug. 17, 2020

(65) Prior Publication Data

US 2021/0060621 A1 Mar. 4, 2021

Related U.S. Application Data

(60) Provisional application No. 62/891,682, filed on Aug. 26, 2019.

(51) Int. Cl.
*B08B 3/00* (2006.01)
*B08B 9/032* (2006.01)

(52) U.S. Cl.
CPC ..... *B08B 3/003* (2013.01); *B08B 9/0328* (2013.01); *B08B 2203/007* (2013.01); *B08B 2209/032* (2013.01)

(58) Field of Classification Search
CPC . B08B 3/003; B08B 9/0328; B08B 2203/007; B08B 2209/032; F28G 9/00
See application file for complete search history.

(56) References Cited

U.S. PATENT DOCUMENTS

| | | | | |
|---|---|---|---|---|
| 3,037,887 | A * | 6/1962 | Brenner | B08B 3/003 134/22.18 |
| 3,436,262 | A * | 4/1969 | Duranleau | F28G 9/00 134/10 |
| 4,133,773 | A * | 1/1979 | Simmons | B08B 3/003 134/22.1 |
| 4,332,292 | A | 6/1982 | Garberick | |
| 5,911,742 | A * | 6/1999 | Akazawa | F24F 1/0053 62/78 |
| 6,027,572 | A * | 2/2000 | Labib | A61C 1/0076 134/22.12 |
| 2003/0215934 | A1 | 11/2003 | Rothweiler | |
| 2009/0114247 | A1* | 5/2009 | Brown | E21B 37/06 134/3 |
| 2012/0111375 | A1* | 5/2012 | Ass | B08B 7/0007 134/37 |
| 2015/0144303 | A1 | 5/2015 | Burfeind | |
| 2017/0167290 | A1* | 6/2017 | Kulkarni | F01D 25/002 |
| 2017/0171768 | A1 | 6/2017 | Kim et al. | |
| 2017/0191768 | A1* | 7/2017 | Metropoulous | B08B 3/003 |
| 2018/0325117 | A1 | 11/2018 | Holmes | |
| 2021/0060621 | A1* | 3/2021 | Seippel | B08B 9/0328 |

* cited by examiner

*Primary Examiner* — Sharidan Carrillo
(74) *Attorney, Agent, or Firm* — Young Basile Hanlon & MacFarlane, P.C.

(57) ABSTRACT

A cleaning system comprising: (a) one or more pumps; (b) one or more foamers; and (c) one or more cleaning reservoirs including one or more cleaning solutions; wherein the one or more foamers combine a fluid and the cleaning solution to form a foamed solution so that the solution is introduced into a system to be cleaned.

20 Claims, 4 Drawing Sheets

Step 300 – Close isolation valves and drain the system

Step 302 – Refill the system with a foamed solution and circulate through the system for 24-72 hours Step 302' – Remove an end plate to expose one side of the system and apply the foamed solution in a pressurized manner to the system and allow to sit for 8 hours and then repeat.

Step 304 – After step 302 or steps 302' both end plates are removed to expose internal components of the system.

Step 306 – Spraying the system with water heated to 120 °C at 10 MPa so that the material loosened is removed.

Step 308 - Visually inspect the system (e.g., using a borescope) and repeat steps 302, 302', and 306 as needed.

Step 310 – Flush the system with hot water, sanitizing agent, or both, refill the system, and put the system back online.

Figure 6

METHOD AND APPARATUS FOR CLEANING A HEAT EXCHANGER OR WATER SYSTEM

FIELD

The present teachings relate to an improved system and method for cleaning a heat exchanger or water system and specifically internal components of a heating, cooling, and ventilation unit.

BACKGROUND

Typically, over time heating and air conditioning systems become dirty and efficiency of the systems decreases. External cleaning of the systems is performed to remove dust, dirt, biological growth, or a combination so that efficiency is increased relative to a dirty system. High pressure sprayers, caustic chemicals, detergents, or a combination thereof may be used to remove the dirt, debris, or biological growth that may occur on external components of the system. The systems may be small and/or placed within small rooms such that the systems cannot be visibly inspected during cleaning so that verification of cleaning may be challenging. Moreover, interior components of the device may become dirty over time.

Examples of devices and methods for cleaning coils are disclosed in U.S. Pat. No. 4,332,292 and U.S. Patent Application Publication Nos. 2003/0215934; 2015/0144303; 2017/0171768; and 2018/0325117 all of which are expressly incorporated herein by reference for all purposes. Thus, there is a need for method to clean internal components of a heat exchanger, water system, coils, heating and cooling system, or a combination thereof. What is needed is a method and system that removes dirt and debris from internal components a of heat exchanger, water system, coils, heating and cooling system, or a combination thereof. What is needed is a method of determining when a system is clean. What is needed is a method and device that assists in loosening debris from internal components. What is needed is a cleaning agent that assists in removing debris from internal components so that the internal components are cleaned.

SUMMARY

The present teachings provide a system comprising: a cleaning system comprising: (a) one or more pumps; (b) one or more foamers; and (c) one or more cleaning reservoirs including one or more cleaning solutions; wherein the one or more foamers combine a fluid and the cleaning solution to form a foamed solution so that the solution is introduced into a system to be cleaned.

The present teachings provide a method comprising: a method comprising: (a) connecting a cleaning system to a system to be cleaned; (b) connecting a fluid supply to the cleaning system; (c) mixing the fluid supply and cleaning solution together to form a solution; (d) foaming the solution to form a foamed solution; and (e) injecting the foamed solution into the system to be cleaned.

The present teachings provide a method and system that removes dirt and debris from internal components a of heat exchanger, water system, coils, heating and cooling system, or a combination thereof. The present teachings provide a method of determining when a system is clean. The present teachings provide a method and device that assists in loosening debris from internal components. The present teachings provide a cleaning agent that assists in removing debris from internal components so that the internal components are cleaned.

BRIEF DESCRIPTION OF THE DRAWINGS

FIG. 6 is a process of cleaning.

DETAILED DESCRIPTION

Figure 1:
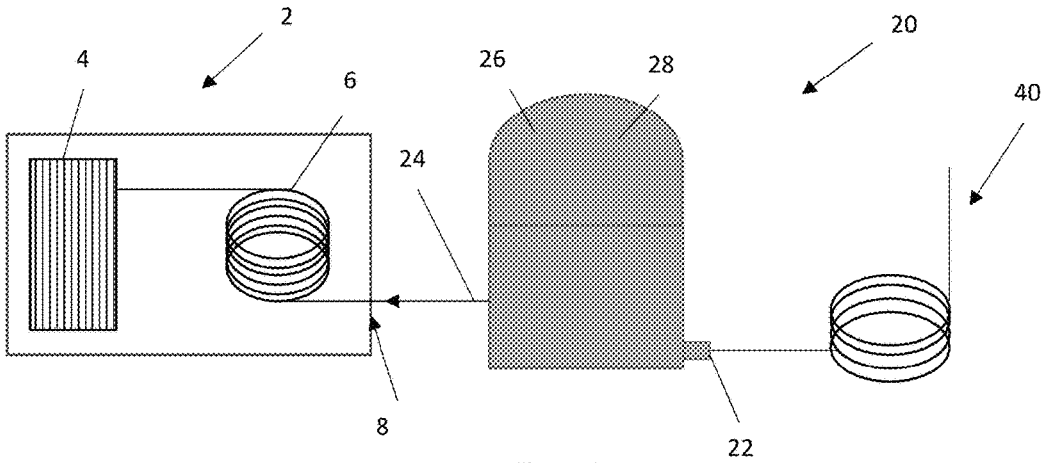
FIG. 1 illustrates a cleaning system and apparatus connected to a system to be cleaned.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings are predicated upon providing a cleaning system. The present teachings provide a cleaning system that functions to connect to and clean a system to be cleaned. The cleaning system functions to clean and remove debris, foiling, contaminants, or a combination thereof (i.e., debris) from an inside or outside of a system to be cleaned (e.g., refrigeration system, cooling loops, self-contained water systems, potable water systems in buildings, plumbing systems, industrial tooling, heating, ventilation, and air conditioning system (HVAC)). Preferably, the system may be used with any closed loop system, system with pipes, a system that holds water or glycol, or a combination thereof. More preferably, the system cleans a water side of a HVAC system. The cleaning system may connect to and clean a closed loop portion of a HVAC system. The cleaning system may carry debris out of the HVAC system. The cleaning system may have a liquid phase, a foamed phase, or both. The cleaning system may apply a liquid and then apply a foam or vice versa. The cleaning system may scrape contaminants from the HVAC system.

The cleaning system may be self-contained. For example, once filled the cleaning system may not require any outside inputs to run (e.g., water, electricity, cleaning solution). The cleaning system may have a cleaning inlet, a cleaning outlet or both. The cleaning inlet may function to receive one or more solutions that may be moved through the cleaning system. The cleaning inlet may connect the cleaning system to a water line, a hose, cleaning agents, or a combination thereof. The cleaning inlet may be used to fill or refill the cleaning system. The cleaning inlet may be used to continuously introduce fluid into the system. The cleaning inlet may be used to fill one or more reservoirs. The cleaning inlet may introduce some pressure into the cleaning system. The cleaning inlet may introduce ad fluid and then fluid after passing through the cleaning system may exit the cleaning outlet as a cleaning solution (e.g., solution).

The cleaning outlet may function to introduce the cleaning solution into the system to be cleaned so that the system may be cleaned. The cleaning outlet may function to connect a cleaning system to a system to be cleaned. The cleaning outlet may be a last part of the cleaning system. The cleaning outlet may be connected to one or more hoses, fluid lines, or both. The cleaning outlet may be located downstream from the pump, foamer, grit reservoir, compressor, cleaning reservoir, a water reservoir, or a combination thereof. The cleaning outlet may directly connect the cleaning system to the HVAC system (i.e. system or system to be cleaned).

The pump functions to move the solution from the cleaning system to the system for cleaning. The pump may mix water with a cleaning solution, grit, or a combination thereof. The pump may move fluid, solution, or both to a foamer where the solution is turned into a foam. The pump may bypass the foamer and pump a liquid directly into the system to be cleaned. The pump may pull a fluid from a reservoir, push a fluid, push a solution, or a combination thereof. The pump may be a centrifugal pump, a positive displacement pump, a diaphragm pump, include an impeller, include a rubber diaphragm, a rotary pump, a piston pump, a screw pump, a gear pump, a vane pump, or a combination thereof. The pump may create a pressure of about 250 KPa or more, about 500 KPa or more, 750 KPa or more, about 1,000 KPa or more, about 1,500 KPa, or even about 2,500 KPa or more. The pump may create a pressure of about 12,000 KPa or less, about 10,000 KPa or less, about 7,500 KPa or less, or about 5,000 KPa or less. The cleaning system may include one or more pumps. The cleaning system may include a pump that moves a fluid through the various reservoirs (e.g., grit, cleaning, or both) to create the cleaning solution. The cleaning system may include a pump that moves the solution to the foamer. The cleaning system may include a pump after the foamer to move the foamed solution to the HVAC system. The pump may be a multi-stage pump. For example, the pump may create and mix grit, cleaning solutions, or both into water, move the solution to the foamer, move the foamed solution to the HVAC system, move a mixture of water and grit and/or cleaning solution to a system to be cleaned, or a combination thereof. A single pump may be located near the cleaning inlet that creates a pressure to move the fluid, solution, and foamed solutions through and out of the cleaning system. The pump may move a fluid into, out of, through, or a combination thereof one or more foamers and/or system to be cleaned.

The one or more foamers may function to turn the solution, a fluid, a cleaning solution, or a combination thereof into a foam, a semi-solid, a flowable material, or a combination thereof. The one or more foamers may introduce air into a liquid so that the liquid is turned into a mass of bubbles. The foamer may foam all of the solution, liquid, or both so that none of the solution, liquid, or both remain in liquid form. The foam may have surface tension that holds all of the liquid within the foam so that the foam carries the cleaning solution and cleans. The foamers may increase a viscosity of a fluid, cleaning solution, solution, or both. The foamer may create a foam with a density of about 0.5 g/cc or more, about 0.75 g/cc or more, or about 0.9 g/cc or more. The foamer may create a foam with a density of about 2.0 g/cc or less, about 1.5 g/cc or less, or about 1.1 g/cc or less. The foamer may create a foam with an elastic modulus of about 2,000 Pa or more, about 4,000 Pa or more, about 6,000 Pa or more, about 8,000 Pa or more or about 10,000 Pa or more. The foamer may create a foam with an elastic modulus of about 20,000 Pa or less, about 18,000 Pa or less, about 16,000 Pa or less, about 14,000 Pa or less, or about 12,000 Pa or less. The foamer may create a foam with a viscous modulus of about 500 Pa or more, about 1,000 Pa or more, about 2,000 Pa or more, about 3,000 Pa or more, about 4,000 Pa or more, about 5,000 Pa or more, about 6,000 Pa or more, about 7,000 Pa or more, or even about 8,000 Pa or more. The foamer may create a foam with a viscous modulus of about 15,000 Pa or less, about 13,000 or less, about 11,000 Pa or less, about 10,000 Pa or less, or about 9,000 Pa or less. The foamer may inject air into the fluid or the solution so that a liter of foamed solution has about 80 percent solids or less, about 70 percent solids or less, about 60 percent solids or less, about 50 percent solids or less, about 40 percent solids or less, or about 30 percent solids or less. The foamer may inject air into the fluid or the solution so that a liter of famed solution has about 5 percent solids or more, about 10 percent solids or more, about 15 percent solids or more, 20 percent solids or more, or about 25 percent solids or more. The foamer may introduce grit into the solution as the foamer foams the solution.

The grit may function to clean, remove scale, abrade, polish, or a combination thereof an internal portion of a system (e.g., a heat exchanger, coil, or both). The grit may be added to a liquid phase, a foamed phase, or both. The grit may remove high spots. The grit may remove hard to remove materials. The grit may be added in a final stage of cleaning. The grit may be or include sand, metal, glass, an organic substance, an inert substance, inorganic substance, a naturally occurring substance, silicate, a graphene, or a combination thereof. The grit may be an insoluble material. If the grit is or includes graphene the graphene may be a scale, plate, pillar, tube shaped, or a combination thereof. The graphene may be a nanoplatelet. An example of a graphene that is commercially available is sold under the tradename xGnP. The graphene may be sufficiently light that the graphene may be suspended within the foamed solution. The graphene may bond to surfactant within the foamed solution. The graphene may assist in densifying the foamed solution, removing particles from the walls of the system, coils, heat exchanger, or a combination thereof. The grit may be a soluble material. For example, the grit may be sodium chloride. The grit may have an average particle size of about 1 μm or larger, about 5 μm or larger, about 10 μm or larger, about 25 μm or larger, about 50 μm or larger, or about 75 μm or larger, or about 100 μm or larger. The grit may have an average particle size of about 2 mm or less, about 1 mm or less, about 0.5 mm or less, about 0.25 mm or less, or about 0.125 or less. The graphene may have a particle size of about 200 μm or less, about 100 μm or less, or about 75 μm or less. The graphene may have a particle size of about 25 μm or more, about 40 μm or more, or about 40 μm or more. The grit may have a maximum particle size of about 3 mm or less, preferably about 2 mm or less, and more preferably about 1 mm or less. The grit may be a combination of particle types and particle sizes. The grit may be sufficiently small that the grit may be suspended within the foam. The foam may include a sufficient amount of grit that the grit cleans an entire surface area of the system, a water system, a heat exchanger, a coil, an inlet, an outlet, or a combination thereof. The grit may be held in suspension so that an entire inner circumference of the pipe may be cleaned by the grit. The foam may include grit in an amount of about 0.25 percent by volume or more, about 0.5 percent by volume or more, about 1 percent by volume or more, about 2 percent by volume or more, or about 3 percent by volume or more. The foam may include grit in an amount of about 20 percent by volume or less, about 15 percent by volume or less, about 10 percent by volume or less, or about 5 percent by volume or less. The foam may include grit in an amount of about 1 percent or more, about 3 percent or more, about 5 percent or more, or even about 10 percent or more by mass of a volume of a foam and grit mixture (e.g., 1 L of foam may be 10 percent by mass grit). The foam may include grit in an amount of about 50 percent or less, about 40 percent or less, about 30 percent or less, about 20 percent or less, or even about 15 percent or less by mass of a volume of foam and grit mixture. The grit may be applied continuously during cleaning. The grit may be applied at an end of the cleaning. The grit may be applied in a last 20 percent or less, last 10 percent or less, or last 5 percent or less of a cleaning step. For example, if cleaning lasts 120 minutes and the grit is applied for 10 percent of the cleaning then the grit may be applied during the last 12 minutes. The grit may be recycled. The grit may be removed with a centrifuge and then recycled back to the foamer or a grit reservoir. Preferably, the grit is disposed after the system is cleaned. The grit may be applied from a grit reservoir.

The grit reservoir may function to supply grit to the cleaning solution, the foamed cleaning solution, liquid solution before the foamer, after the solution is foamed, or a combination thereof. The grit reservoir may meter the grit into the foam, solution, or both. The grit reservoir may store enough grit to clean one or more systems, two or more systems, three or more systems, or even four or more systems before the grit reservoir needs to be refilled. The grit reservoir may hold enough grit to clean ten or less systems, eight or less systems, or five or less systems. The grit reservoir may be a tank that is part of the cleaning system. The grit reservoir may be a cartridge that is replaceable once the grit reservoir is empty so that multiple grit reservoirs may be carried along and changed during operation without the need to refill the grit reservoir. The grit reservoir may be in communication with one or more compressors.

The one or more compressors may function to shock the system with compressed air, to reverse the direction of the foam, to push liquids out of the system, to push debris out of the system, or a combination thereof. The one or more compressors may inject air into the foam, the cleaning solution, compressed fluid, compressed cleaning solution, grit, or a combination thereof into the system on a periodic basis. The compressor may intermittently shock the system with a compressed air or a compressed fluid. The compressor may inject slugs of air, slugs of fluid, or both into an inlet, an outlet, a heat exchanger, a coil, or a combination thereof. The one or more compressors may inject a fluid (e.g., air, solution, water) into the system at a pressure of about 300 KPa or more, about 500 KPa or more, about 650 KPa or more, or about 800 KPa or more. The one or more compressors may inject a fluid into the system at a pressure of about 2000 KPa or less, about 1500 KPa or less, or about 1000 KPa or less. The compressor may send a compressed fluid for a duration of about 1 millisecond or more, about 10 milliseconds or more, about 25 milliseconds or more, about 50 milliseconds or more, about 100 milliseconds or more, about 250 milliseconds or more, about 500 milliseconds or more, about 750 milliseconds or more, about 1 second or more, or about 3 seconds or more. The compressor may second a compressed fluid for a duration of about 1 minute or less, about 30 second or less, about 15 seconds or less, about 10 seconds or less, or about 5 seconds or less. The compressor may send a compressed fluid about 1 time per minute or more, about 2 times per minute or more, about 5 times per minute or more, about 10 times per minute or more, about 50 times per minute or more, about 100 times per minute or more, about 250 times per minute or more, or even about 500 times per minute or more. The compressor may send a compress fluid about 5000 times per minute or less, about 3000 times per minute or less, about 1500 times per minute or less, or about 1000 times per minute or less. The compressor may operate from start to finish of a cleaning cycle. The compressor may operate during a last 50 percent, last 40 percent, last 30 percent, last 20 percent, or last 10 percent of a cleaning cycle. The compressor may operate once fluid begins exiting a second side of the system. For example, once foam has entered the inlet and exited the outlet the compressor may begin operation. The compressor may be used intermittently. For example, every 15, 10, 5, 3, 2, or a combination thereof minutes of cleaning the compressor may run for 1 minute, 30 second, 20 seconds, or a combination thereof. The compressor may supply some fluid into the cleaning reservoir to assist in moving a cleaning solution from the cleaning reservoir into the foamer, towards the cleaning outlet, or both.

The cleaning reservoir may function to hold a cleaning solution, supply a cleaning solution to a foamer, supply a cleaning solution into water to create a solution, or a combination thereof. The cleaning reservoir may hold a sufficient amount of fluid to clean one or more systems, two or more systems, three or more systems, or even four or more systems. The cleaning reservoir may be a cartridge that can be replaces with another full cleaning reservoir so that no refilling is needed during operation. The cleaning reservoir may inject cleaning solution into water supplied from the water supply line so that the cleaning solution and the water are mixed to create a solution. The cleaning reservoir may be connected to a water supply line to dilute the cleaning solution.

The cleaning solution functions to remove foiling from the system so that heat exchange is increased relative to the system before the foiling is removed. The cleaning solution functions to kill or remove biofilm. The biofilm may be any of the biological material, bacteria, or both that is discussed herein that form a film layer on one or more components of the system. The cleaning solution may include one or more enzymes, enzymes protease, enzymes lipases, enzymes amylases, prebiotic fibers, probiotic, one or more species of Bacilli, a stabilizer, a surfactant, or a combination thereof. A surfactant may be used to change pH, improve wetting, adjust surface tension, improve penetration of the cleaning solution or probiotics into bacteria, or a combination thereof. The surfactant may be sodium lauryl sulfate, an anionic surfactant, dioctyl sodium sulfosuccinate, perfuoroctanesulfonate, perfluorobutanesulfonate, alkyl-aryl ester phosphates, alkyl ether phosphotates, carboxylates, carboxylate salts, sodium stearate, cationic surfactants, amines, quaternary ammonium salts, cetrimonium bromide, cetylpyridinium chloride, benzalkonium chloride, benzethonium chloride, diamthyldioctacecylammonium chloride, dioctadecylidamethylammonium bromide, or a combination thereof. Some probiotics that may be included in the cleaning solution are found in WO2017074485, the teachings of which are expressly incorporated by reference herein and especially for teachings related to probiotics and compositions used with probiotics. A probiotic may be inulin. The prebiotic may be a soluble fiber. The prebiotic may be made from or derived from chicory root, bananas, asparagus, or a combination thereof. The cleaning solution may be mixed with water. The cleaning solution and water may be mixed to a ratio of cleaning solution to water of about 1:5 or more, about 1:10 or more, about 1:15 or more, or about 1:20 or more. The foamed solution has a ratio of cleaning solution to fluid of about 1:5 or more and about 1:100 or less. The cleaning solution and water may be mixed to a ratio of cleaning solution to water of about 1:100 or less, about 1:75 or less, about 1:50 or less, or about 1:25 or less. For example, for every liter of cleaning solution about 19 L of water may be used. The cleaning solution and the water may be mixed together to form a solution. The solution may be foamed. For example, 20 L of solution may be foamed into about 190 liters of foamed solution. The cleaning solution and the water supply line may be fed into the foamer to create the foamed solution.

The water supply line functions to provide fresh water into the cleaning system so that a solution may be provided into the system and the system cleaned. The water supply line may provide any fresh water source. The water supply line may provide 15 liters per minute or more, about 35 liters per minute or more, about 55 liters per minute or more, about 75 liters per minute or more, or about 400 liters per minute or less of fresh water to the cleaning system. The water supply line may function to provide a sufficient amount of water to create about 75 liters of foam per minute or more, about 125 liters of foam per minute or more, about 150 liters of foam per minute or more, or about 400 liters of foam per minute or less. The water supply line may function to recirculate foam or liquid from an exit location of a system to be cleaned. The water supply line may initially provide water into the system and then once the system is operating may recirculate the cleaning solution. The water from the water supply line may dilute the cleaning solution to create a solution. The water and cleaning solution may be formed into a foam solution that is moved through the system.

The foamed solution functions to carry removed material from the system. The removed material may be dirt, debris, corrosion, a microbe, biological material, mold, bacteria, a bio film, slime, microorganisms, *Acinetobacter, Klebsiella, Pseudomonas, Enterococcus, Bacillus, B. Subtilis, B. Pumilus, B. Cereus, B Megaterium*, or a combination thereof. The foamed solution may be sufficiently dense that removed material, grit, or both may be removed from the system. The foamed solution may carry particles of removed material from the system so that as the system is cleaned the material cleaned from the walls is no longer located within the system. The removed material may be filtered out of the foamed solution as the foamed solution is recirculated.

The filter may function to remove debris, dirt, corrosion, microbes, biological material, or any other substances discussed herein for the removed material. The filter may remove the grit so that the grit may be recirculated. The filter may include a single stage. The filter may be a multiple stage filter. The filter may be sufficiently small to remove material from the foamed solution that is not used for cleaning or is not beneficial to the cleaning process. The filter may be sufficiently large so that the entire volume of foamed solution may be recycled within the system once every 15 minutes. The filter may expunge the removed material. The filter may be a 100 micron filter or less, a 75 micron filter or less, a 50 micron filter or less, or a 25 micron filter or less. The filter may be 1 micron or more, 5 microns or more, about 10 microns or more, or about 15 microns or more (i.e., about 20 microns). The filter may continuously filter out removed material as the system is being cleaned.

The system to be cleaned may be any system that circulates a fluid and over time the fluid may foil, a film may form on one or more walls of the system, or both. The system may be an air conditioning system, a heating system, a heat pump system, a heat exchanger, a water system, a system including a heat exchanger, coils, a condenser, industrial process water, glycol water mix cooling water, heating water, chilled water, cooling water, potable hot water, potable cold water, gray water, irrigation water, fire suppression sprinkles, fountains, decorative water features, any other system discussed herein, or a combination thereof. The coils may be a series of helically wrapped metal tubes. The coils may be copper pipes, aluminum pipes, or both that have a concentric center. The system may include one or more coils, one or more heat exchangers, or both. The system may include a water system. The water system may be a closed loop portion of the system where water is maintained for thermal exchanges. For example, the water system may remove heat, remove cold, or both. The water system may circulate fresh water. The water system may be a closed loop. The water system may include one or more coils, one or more heat exchangers, one or more inlets, one or more outlets, or a combination thereof.

The heat exchanger may function to remove waste heat, waste cool, or both from a fluid. The heat exchanger may include a fluid in the inside that removes heat and/or passes heat to air flowing over the heat exchanger. The heat exchanger may be any heat exchanger that provided thermal conduction. Preferably, the heat exchanger includes fins for cooling air that flows over the heat exchanger. The heat exchanger may be a shell and tube, double heat pipe, plate, condenser, evaporator, DX coils, microchannel type, fin and tube, plate and frame, chiller tube bundles, cooling towers, or a combination thereof. The system, heat exchanger, water system, coils, or a combination thereof include an inlet and an outlet.

The system may be filled through an inlet. The system may be drained through an outlet. The inlet may be connected to the outlet when the system is running so that fluid is recirculated through the system. The inlet may connect to fresh water, glycol, or both. The outlet may be located near a drain. The system may not include an inlet, an outlet, or both and an inlet, an outlet, or both may be added into the system to clean the system. The inlet and the outlet may be used during a method of cleaning the system.

The method may include one or more of the following steps in virtually any order. The cleaning system may be connected to an inlet, an outlet, or both. The cleaning system may mix water and cleaning solution together. The solution may be foamed. The cleaning solution and water may be mixed by the foamer to create a solution. Grit may be mixed into the solution, the cleaning solution, the water, the foamer, or a combination thereof. The heat exchanger, the coils, the system, or a combination thereof may be purged of air. The purging may occur thought the outlet, the inlet, a separate purge location that is added, a purge location within the system, or a combination thereof. The purging may occur while the foam, the solution, or both are pumped into the system. Compressed fluid may be introduced into the inlet, the outlet, or both. Compressed air may move the foam, the foamed solution, or both. Compressed air may shock debris on walls of the system. The foamed cleaner may be pumped into the system until the system is full and then the system may sit. The system may sit for 6 hours or more, 8 hours or more, 12 hours or more, 18 hours or more, or even 24 hours or more. The system may sit for 48 hours or less, 40 hours or less, 36 hours or less, or 30 hours or less. The isolation valves may be closed. The system may be emptied of fluid (other than air). The system may be filled with foamed cleaner. The foamed cleaner may be circulated, recirculated, or both for 10 minutes or more, 15 minutes or more, or 30 minutes or more. The foamed cleaner may be circulated, recirculated, or both for 1 hour or less or 30 minutes or less. The foamed cleaner may be circulated, recirculated, or both every 30 minutes or more, hour or more, 2 hours or more, or 4 hours or more. The foamed cleaner may be circulated once every 5 minutes or more, 10 minutes or more, or 12 minutes or more. The foamed cleaner may be circulated once every 60 minutes or less, 45 minutes or less, 30 minutes or less, or 20 minutes or less (i.e., once every 15 minutes). The foamed cleaner may be recirculated about 25 percent of the time the system is connected to the cleaning system. For example, the foamed cleaner may be circulated for 15 minutes out of every hour. The system may be cleaned in a first direction. The system may be cleaned in a second direction. The system may be cleaned in a first direction, a second direction, or both for 12 hours or more, 24 hours or more, 36 hours or more, or 48 hours or more. The system may be cleaned for 72 hours or less or 60 hours or less in the first direction, the second direction, or both. The system may be flushed with water. The foamed cleaner may be visually inspected as the foam cleaner exits the inlet, the outlet, the system, or a combination thereof. The system to be cleaned may be isolated from other systems, redundant subsystems, or both. After the foamed cleaner is allowed to rest more foam may be introduced. For example, the foam cleaner may be allowed to rest for 5 minutes or more, 10 minutes or more, or 15 minutes or more before more foam is introduced into the system. The foam cleaner may be allowed to rest for 2 hours or less, 1 hour or less, or 30 minutes or less before more foam is introduced into the system. Air may be introduced into the system. Air may be introduced to force foamed cleaner into dead legs, air locked structures, or both. The air may be introduced after more foam is introduced into the system, before more foam is introduced into the system, after the system rests, or a combination thereof. A pressure of the system at the inlet and the outlet may be monitored. The inlet pressure may be compared to the outlet pressure. If the inlet pressure and the outlet pressure when compared are substantially the same then cleaning is terminated (e.g., with about 10 percent or less, about 7 percent or less, or about 5 percent or less). The system is flushed with clean water. The water, cleaning solution, foamed solution, or a combination thereof may be heated. The heating may be about 20 degrees C. or more, about 30 degrees C. or more, about 40 degrees C. or more, or even about 50 degrees C. or more. The heating may be to about 75 C or less or about 60 C or less. One or more testing may be performed before cleaning begins, after cleaning is performed, or both. The testing may test for an amount of cellular activity, type of cellular activity, or both (an amount or type of bacteria present). The testing may be performed to determine a level of cleanliness, bacteria parts per million or parts per billion present. The testing may be an adenosine triphosphate (ATP) test, DNA sequencing test, or both.

The ATP testing functions to quantify a cleanliness, provide a quantity of microorganisms (e.g., bacteria) present, provide a before and after comparison, or a combination thereof. The ATP testing may be done with a swab, by using a sample of water, or both. The ATP testing may be performed onsite. The ATP testing may use a handheld device that measures a concentration of ATP found in a sample. The ATP testing may be used to determine a load of cleaning solution needed to clean a system. The ATP testing may be done during cleaning to determine if additional cleaning is needed or if cleaning is complete. The ATP testing may be performed in addition to DNA sequencing.

DNA sequencing functions to determine type of microorganisms (e.g., bacteria) present. The DNA sequencing may provide information related to types of cleaning agents that may be used, effectiveness of cleaning agents, or both. The DNA sequencing may provide information regarding a number of different microorganisms are present in the system. The DNA sequencing may allow a user to customize cleaning agents that may be used to clean the system. The DNA sequencing may be performed before, during, after, or a combination thereof cleaning the system.

FIG. 1 illustrates a system 2 that has a water system with a heat exchanger 4 and coils 6. The system 2 includes an inlet 8 and an outlet 10 that can be used to introduce fluid into the heat exchanger 4 and coils 6. A cleaning system 20 has a cleaning outlet 24 that is connected to an inlet 8. The cleaning system 20 includes an inlet 22 where fluid is introduced and as shown is connected to a water supply line 40. The cleaning system 20 includes a pump 26 and a foamer 28 that create and move foam (not shown) through the system 2 to clean the system 2.

Figure 2:
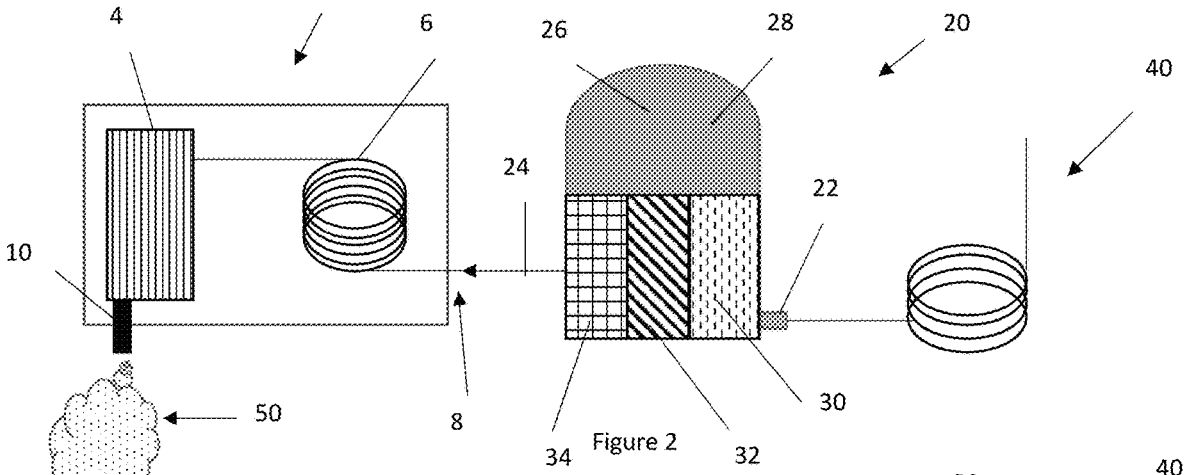
FIG. 2 illustrates the cleaning system and apparatus cleaning the system from a first side.

FIG. 2 illustrates the cleaning system 20 connected to the system 2. A water line 40 is connected to the cleaning system 20. Water is supplied into the cleaning inlet 22 and is moved through the cleaning system buy the pump 26. As the water moves through the system 2, grit may be added from a grit reservoir 30, a cleaning solution may be added from the cleaning reservoir 34, or the water may be subjected to additional pressure from the compressor 43. The water and grit, cleaning solution, or both is then moved to the foamer 28 where the solution is turned into a foam and then pumped by the pump 26 out the cleaning outlet 24 and into the inlet 8. Once in the inlet 8 the foamed solution passes through the coils 6, heat exchanger 4 and then out the outlet 10. As shown, the foam and solution mix with debris to be expelled from the outlet 10 as removed material 50.

Figure 3:
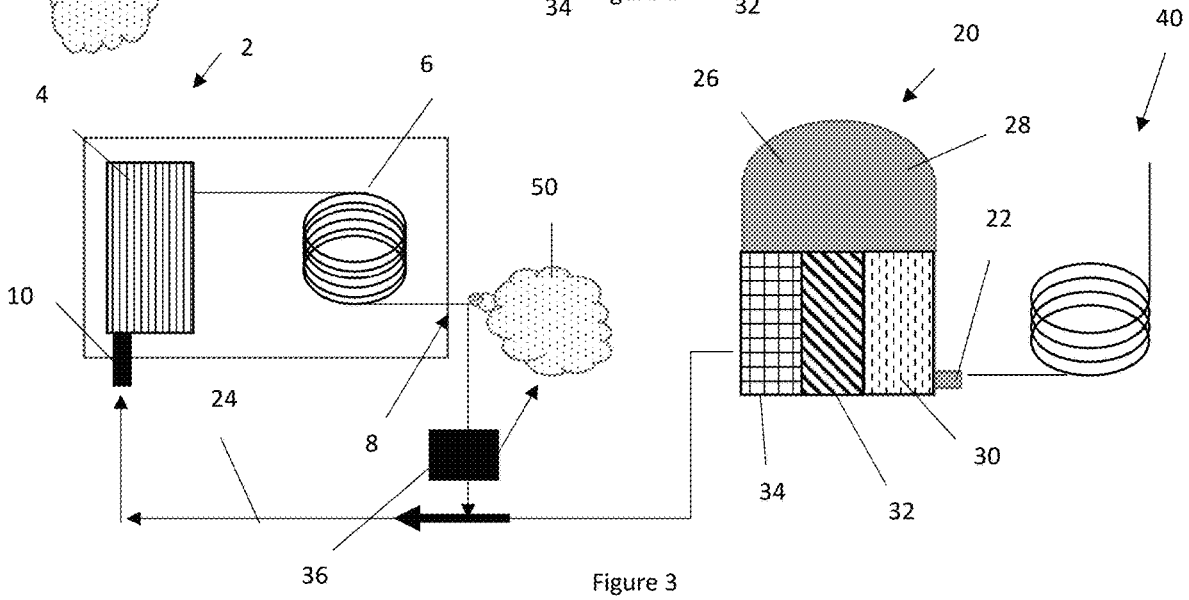
FIG. 3 illustrates the cleaning system and apparatus cleaning the system from a second side.

FIG. 3 illustrates the cleaning system 20 connected to the system 2. A water line 40 is connected to the cleaning system 20. Water is supplied into the cleaning inlet 22 and is moved through the cleaning system buy the pump 26. As the water moves through the system 2, grit may be added from a grit reservoir 30, a cleaning solution may be added from the cleaning reservoir 34, or the water may be subjected to additional pressure from the compressor 43. The water and grit, cleaning solution, or both is then moved to the foamer 28 where the solution is turned into a foam and then pumped by the pump 26 out the cleaning outlet 24 and into the outlet 10. The cleaning solution is then moved through the heat exchanger 4 and coil 6 to the inlet 8 in a reverse direction of FIG. 2 until removed material 50 is dispelled from the inlet 8. While the solution is being pumped the compressor 32 is activated to shock the system and the foam in order to loosen and remove debris in the removed material 50.

Figure 4:
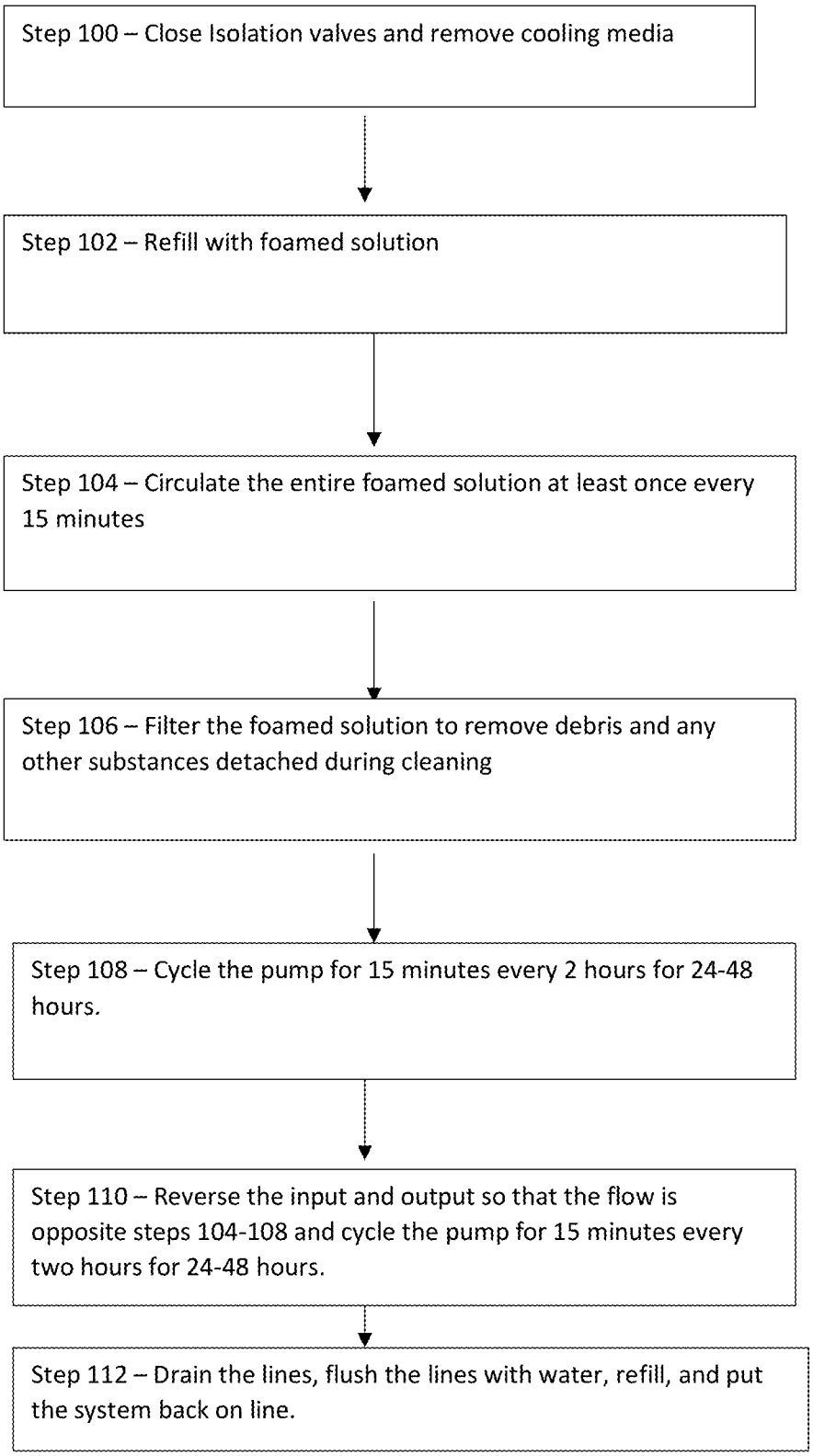
FIG. 4 is a process of cleaning.

FIG. 4 illustrates step in a process of cleaning. The process may be used for fin and tube coils, plate and frame internal cleaning, or both. The process includes closing isolation valves within the system and draining the system 100. The system is then refilled with a foamed solution 102. The foamed solution is then circulated through the system so that an entire volume of the foamed solution is turned over at least once every 15 minutes 104. The foamed solution is filtered to expunge any removed material while the foamed solution is circulated through the system 106. The pump is turned on for at least 15 minutes every two hours to circulate and filter the foamed solution. Step 108 occurs for at least 24 hours and less than 48 hours. The pump is moved from an inlet to an outlet or vice versa and the foamed solution is circulated in a second direction, which is opposite the first direction. This is done for at least 15 minutes every 24 hours to 48 hours 110. Finally, the foamed solution is removed, the lines are flushed, and the system is refilled so that the system can go back online 112.

Figure 5:
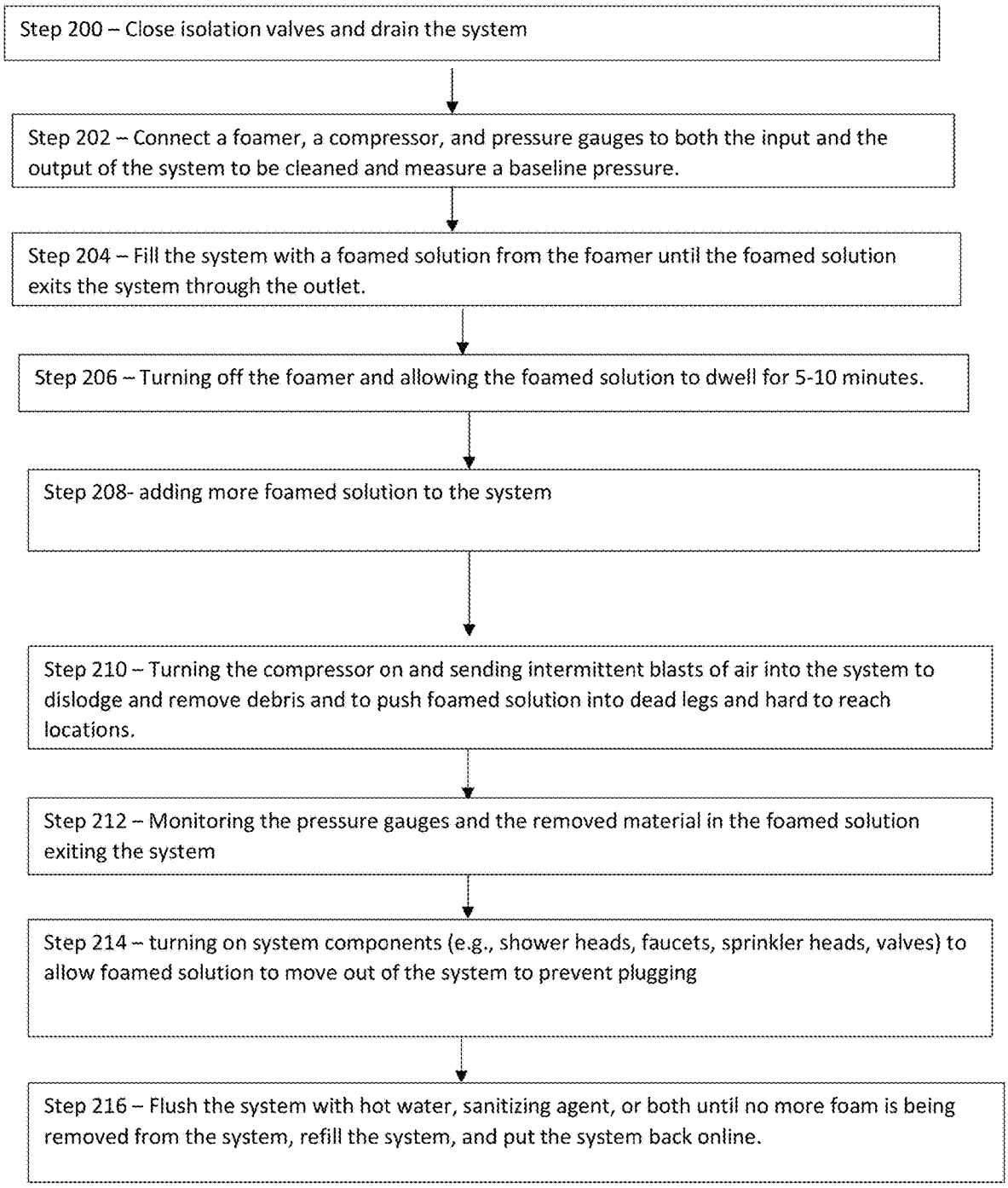
FIG. 5 is a process of cleaning.

FIG. 5 illustrates a process of cleaning. The process of cleaning may be used for heat exchangers and piped water systems. The isolation valves are closed and the system is drained 200. A foamer and compressor are connected to the system and pressure gauges are connected to both the input and the output of the system. A baseline pressure is measured once the system is filled 202. The system is filled with a foamed solution from the foamer until the foamed solution exits the system through outlet 204. The foamer is turned off and the system dwells with the foamed solution for 5-10 minutes 206. More foamed solution is added to the system 208. The compressor supplies intermittent blasts of air to dislodge and remove debris and push the foamed solution into dead legs 210. The pressure gauges are monitored for the pressure drop and the foamed solution exiting the system is monitored for debris 212. Dead legs and legs with valves are purged 214. The system is flushed with hot water, sanitizing agent, or both until no more foam is observed, the system is refilled, and then may be put back online 216.

FIG. 6 is a process of cleaning. The process of cleaning may be used for chiller tubes or heat exchanger tubes. The isolation valves are closed and the system is drained 300. The system if filled with a foamed solution and the foamed solution is circulated for 24 to 72 hours 302. In addition to step 302 or alternatively to step 302 an end plate may be removed and a foamed solution is pressurized and sprayed on the internal components and allowed to sit for at least 8 hours 302'. Step 302' may be repeated one or more times as needed to clean the system. Both end plates are removed after 302 or step 302'. The system is sprayed with heated water that is heated to 102 C and at 10 MPa so that loosened material is removed 306. The system is visually inspected and then steps 302, 302', and 306 are repeated as needed 308. The system is flushed with hot water, sanitizing agent, or both; the system is refilled; and then system is available for placement back online 310.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

2 System
4 Heat Exchanger
6 Coil
8 Inlet
10 Outlet
20 Cleaning System
22 Cleaning Inlet
24 Cleaning Outlet
26 Pump
28 Foamer
30 Grit Reservoir
32 Compressor
34 Cleaning Reservoir
36 Filter
40 Water Supply line
50 Removed material

I claim:

1. A method comprising:

a. connecting a cleaning system to a system to be cleaned;
b. connecting a fluid supply to the cleaning system;
c. mixing a fluid from the fluid supply and a cleaning solution together to form a solution;
d. foaming the solution to form a foamed solution;
e. injecting the foamed solution into the system to be cleaned;
f. bleeding air out of the system to be cleaned while the foamed solution is filling the system to be cleaned, and
g. injecting slugs of air intermittently into the system to be cleaned so that debris on walls of the system to be cleaned are shocked by a shock wave formed by the slug of air as the foamed solution is injected and circulated through the system; and wherein the slugs of air push the foamed solution into dead legs and hard to reach locations and the foamed solution comprises a probiotic.

2. The method of claim 1, wherein grit is introduced into the cleaning system, the foamed solution, or both.

3. The method of claim 1, wherein the slugs of air are introduced into the system to be cleaned after the system to be cleaned is filled with the foamed solution.

4. The method of claim 1, wherein the foamed solution is agitated every other hour, refilled every other hour, cycled every other hour, or a combination thereof.

5. The method of claim 1, wherein the foamed solution is heated.

6. The method of claim 1, wherein the foamed solution is removed from the system to be cleaned and a second foam solution is circulated through the system to be cleaned.

7. The method of claim 1, wherein the foamed solution has a ratio of the cleaning solution to the fluid of about 1:5 or more and about 1:100 or less.

8. The method of claim 1, wherein the foamed solution has an elastic modulus of about 2,000 Pa or more and about 20,000 Pa or less.

9. The method of claim 1, wherein a viscous modulus of the foamed solution is about 500 Pa or more or about 15,000 Pa or less.

10. The method of claim 1, further comprising connecting pressure gauges to an input of the system to be cleaned and an output of the system to be cleaned and measuring a baseline pressure of the system with the pressure gauges.

11. The method of claim 1, wherein the cleaning solution further comprises enzymes, enzymes protease, enzymes lipases, enzymes amylases, prebiotic fibers, one or more species of Bacilli, a stabilizer, a surfactant, or a combination thereof.

12. The method of claim 1, wherein the system to be cleaned is a heating, ventilation, and air conditioning system (HVAC).

13. The method of claim 1, further comprising a step of recirculating the foamed solution that is removed from the system to be cleaned.

14. The method of claim 2, further comprising filtering the grit from the foamed solution as the foamed solution exits the system to be cleaned, wherein the grit is one of sand, metal, glass, and graphene, and the method further comprises a step of recirculating the grit removed from the system to be cleaned back into the system to be cleaned.

15. The method of claim 3, wherein the slugs of air are introduced into the system after the foamed solution is allowed to rest.

16. The method of claim 6, wherein the second foam solution is circulated in an opposite direction.

17. The method of claim 10, further comprising a step of monitoring pressure drops with the pressure gauges.

18. The method of claim 15, wherein the foamed solution is allowed to rest for 15 minutes or more and 55 minutes or less out of every hour.

19. A method comprising:

a. connecting a cleaning system to a system to be cleaned;

b. connecting a fluid supply to the cleaning system;

c. mixing a fluid from the fluid supply and a cleaning solution together to form a solution, wherein the cleaning solution comprises enzymes, enzymes protease, enzymes lipases, enzymes amylases, prebiotic fibers, probiotic, one or more species of Bacilli, a stabilizer, a surfactant, or a combination thereof;

d. foaming the solution to form a foamed solution;

e. injecting the foamed solution into the system to be cleaned;

f. bleeding air out of the system to be cleaned while the foamed solution is filling the system to be cleaned, and g. injecting slugs of air intermittently into the system to be cleaned so that debris on walls of the system to be cleaned are shocked by a shock wave formed by the slug of air as the foamed solution is injected and circulated through the system; and wherein the cleaning solution comprises at least the probiotic and the surfactant.

20. The method of claim 19, wherein the foamed solution has an elastic modulus of about 2,000 Pa or more and about 20,000 Pa or less, and a viscous modulus of the foamed solution is about 500 Pa or more or about 15,000 Pa or less.

* * * * *